US008024823B2

(12) United States Patent
Sanaghan, Jr.

(10) Patent No.: US 8,024,823 B2
(45) Date of Patent: Sep. 27, 2011

(54) WATER CONSERVATION SYSTEM

(76) Inventor: Edward J. Sanaghan, Jr., Tucson, AZ (US)

( * ) Notice: Subject to any disclaimer, the term of this patent is extended or adjusted under 35 U.S.C. 154(b) by 239 days.

(21) Appl. No.: 12/470,481

(22) Filed: May 21, 2009

(65) Prior Publication Data

US 2009/0288246 A1 Nov. 26, 2009

Related U.S. Application Data

(60) Provisional application No. 61/055,197, filed on May 22, 2008.

(51) Int. Cl.
*E03C 1/00* (2006.01)
*A47K 4/00* (2006.01)

(52) U.S. Cl. ..... 4/661; 4/363

(58) Field of Classification Search ..... 4/346, 353, 4/363 X, 365, 661 X, 661 OR
See application file for complete search history.

(56) References Cited

U.S. PATENT DOCUMENTS

| | | | | |
|---|---|---|---|---|
| 3,995,327 | A * | 12/1976 | Hendrick | 4/363 |
| 4,163,293 | A * | 8/1979 | Basterfield | 4/664 |
| 4,371,992 | A * | 2/1983 | Rivera | 4/353 |
| 4,841,578 | A * | 6/1989 | Mercer | 4/224 |
| 5,341,529 | A * | 8/1994 | Serrano | 4/665 |
| 5,347,661 | A * | 9/1994 | Fly et al. | 4/225.1 |
| 5,495,624 | A * | 3/1996 | Lisook et al. | 4/325 |
| 5,522,096 | A * | 6/1996 | Brown | 4/665 |
| 5,913,610 | A * | 6/1999 | Duck | 4/321 |
| 6,019,064 | A * | 2/2000 | Alarcon | 119/247 |
| 6,317,899 | B1 * | 11/2001 | Brewer | 4/365 |
| 6,823,537 | B1 * | 11/2004 | Cummings, III | 4/661 |
| 2009/0165198 | A1 * | 7/2009 | Shalev | 4/415 |

FOREIGN PATENT DOCUMENTS

GB 2062043 A * 5/1981

* cited by examiner

*Primary Examiner* — Brian Glessner
*Assistant Examiner* — Beth A. Stephan

(57) ABSTRACT

A water conservation system comprising a reservoir for storing water; a toilet water tank for storing water, the toilet water tank is disposed below the reservoir; and a tube fluidly connecting the reservoir and the tank, wherein the tube is configured such that a first end of the tube reaches near a bottom surface of the reservoir, a second end of the tube reaches near a bottom surface of the tank, and an elevated portion with a crest that is oriented above the first end.

18 Claims, 7 Drawing Sheets

100
160
140
120
181
220
112
114
103
116
180
106
110
108
104
107
182
102
111

WATER CONSERVATION SYSTEM

FIELD OF THE INVENTION

The present invention is directed to a system to recycle and save water, more particularly to a water conservation system adapted to harvest water from a faucet and deliver it to a toilet tank via a siphoning mechanism.

BACKGROUND OF THE INVENTION

Oftentimes a user must open a hot water faucet for several minutes before hot water arrives at the faucet. This causes a large quantity of water to be wasted. The present invention features a water conservation system for capturing and using this water that would otherwise be wasted. The water conservation system allows a user to harvest the water from a hot water faucet and store it in a reservoir for use in a toilet. The reservoir is connected to a toilet tank via a siphon tube whereby the stored water in the reservoir can be used to fill the toilet tank when the toilet is flushed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1A:
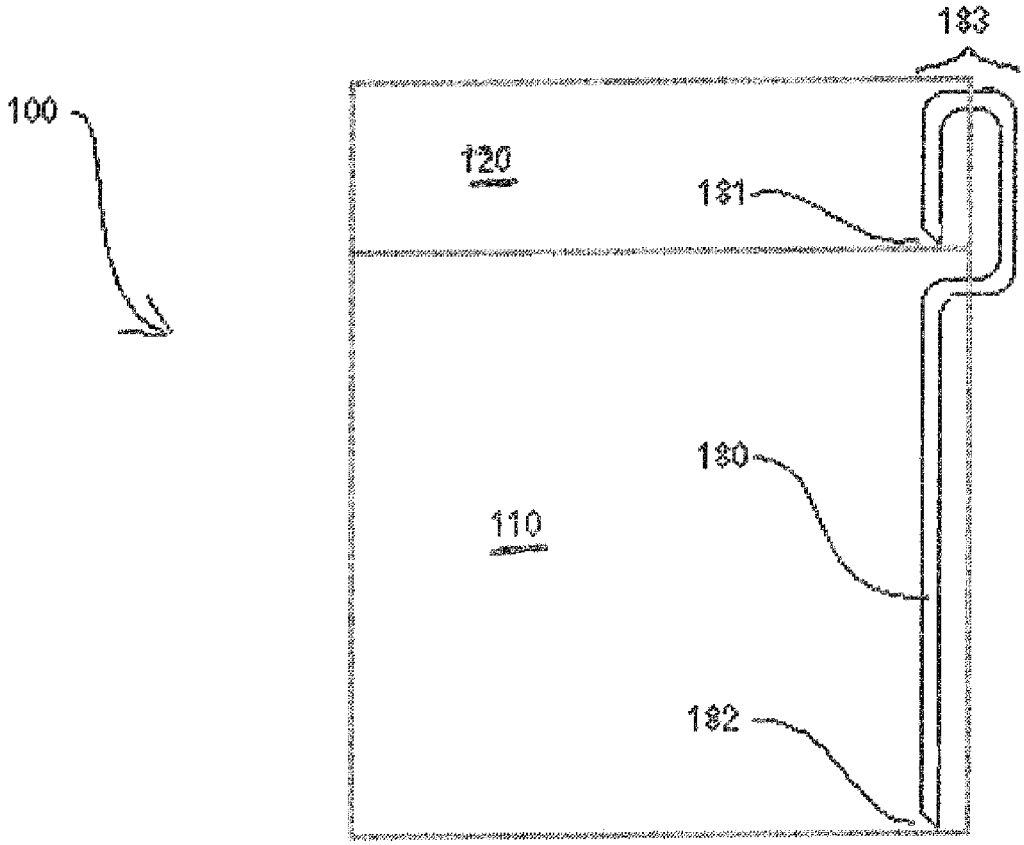
FIG. 1A is a schematic view of the primary functional component of the water conservation system of the present invention.
Figure 1B:
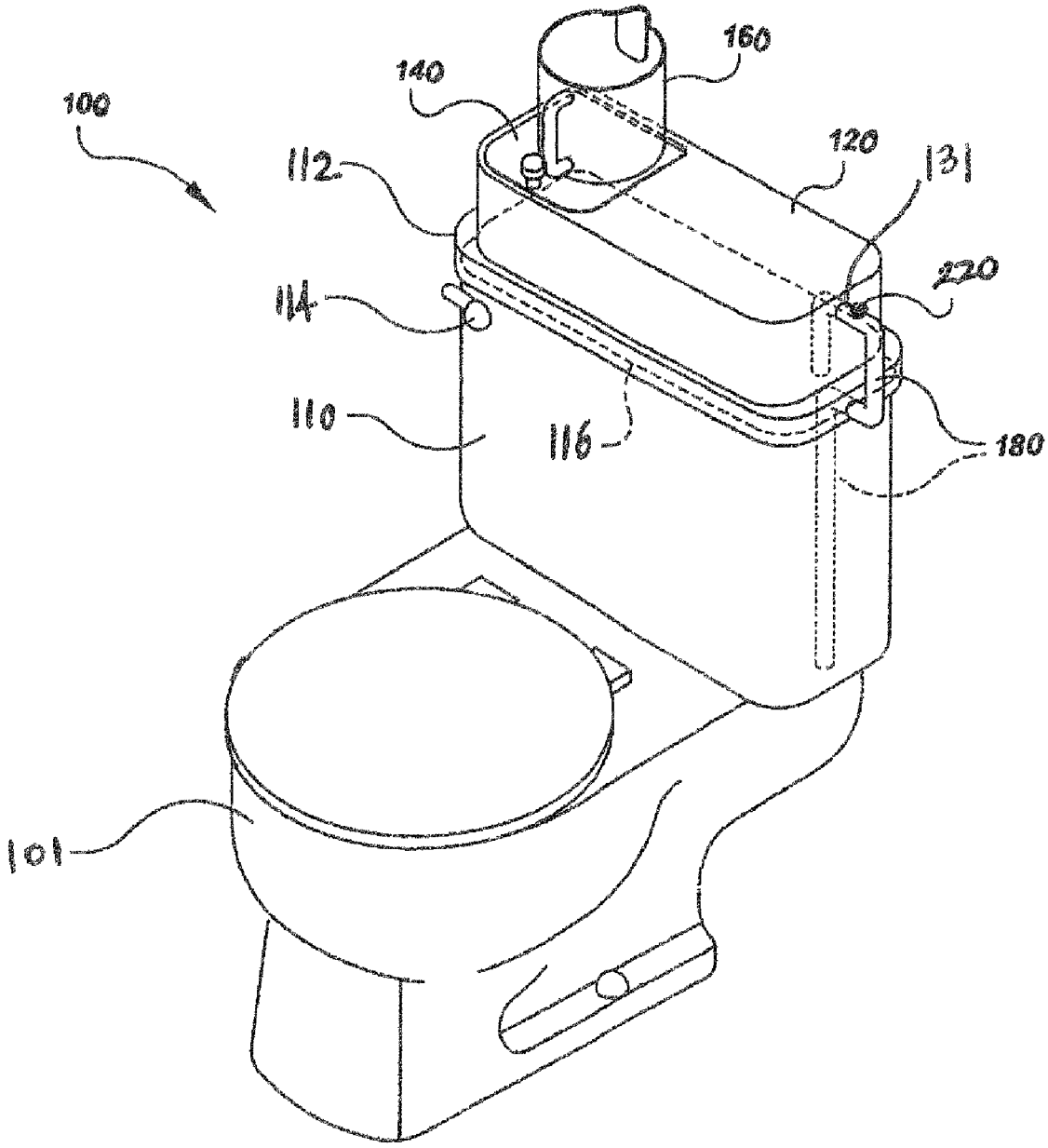
FIG. 1B is a perspective view of an alternative embodiment of the water conservation system of the present invention.

The following is a listing of numbers corresponding to a particular element refer to herein:

100 water conservation system
101 toilet
102 water supply
103 high water level
104 flapper
106 float
107 low water level (toilet tank)
107A low water level (reservoir)
108 overflow tube
110 tank
111 bottom surface of tank
112 lid of tank

114 flush lever of toilet
116 gasket
120 reservoir
131 first aperture
140 lid of reservoir
160 pitcher (one example of delivery to reservoir)
180 siphon tube
181 first end of siphon tube
182 second end of siphon tube
183 elevated portion
185 water aperture
186 notches
220 air vent (wedge type)
220A air vent (membrane type)

Referring now to FIGS. 1-6, the present invention features a water conservation system 100 for capturing and using water from a faucet (e.g., water that may be wasted). The water conservation system 100 may be used to direct water into a conventional toilet 101. Toilets and components thereof are well known to one of ordinary skill in the art.

Figure 2:
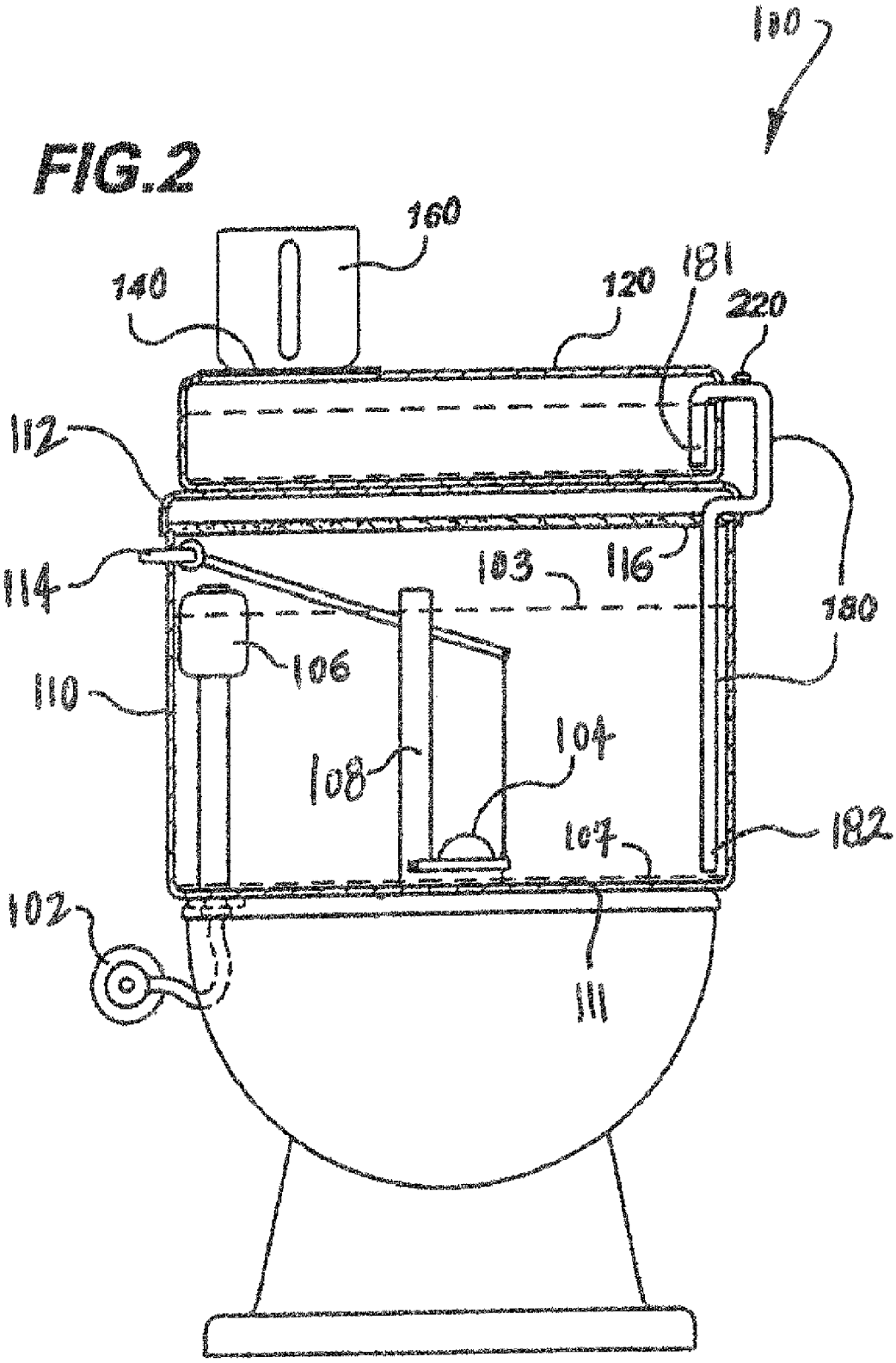
FIG. 2 is a front and partial cross sectional view of the water conservation system of FIG. 1.
Figure 3:
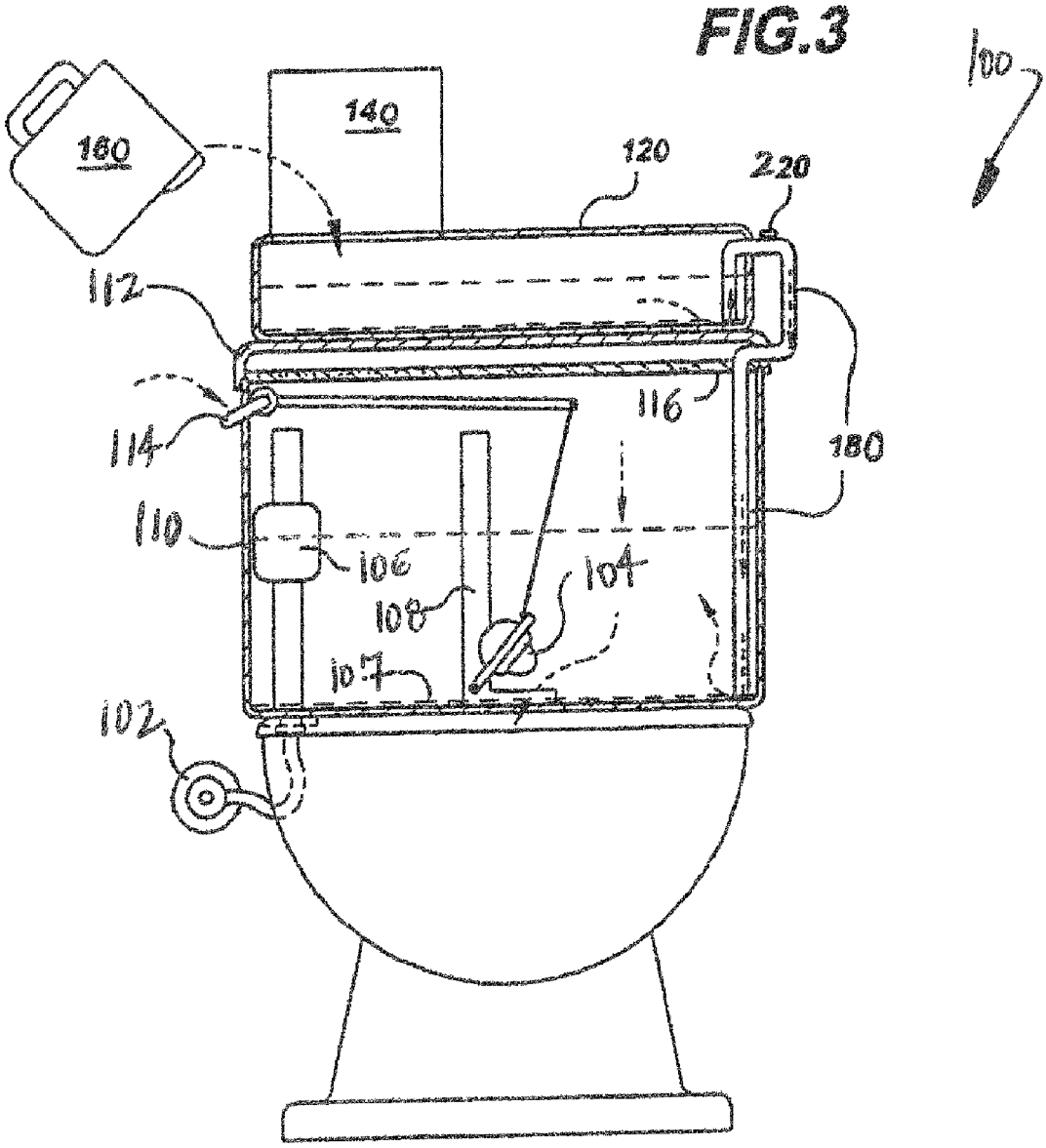
FIG. 3 is a cross sectional view of the water conservation system being used in a manual manner (e.g., adding water via a pitcher).
Figure 4:
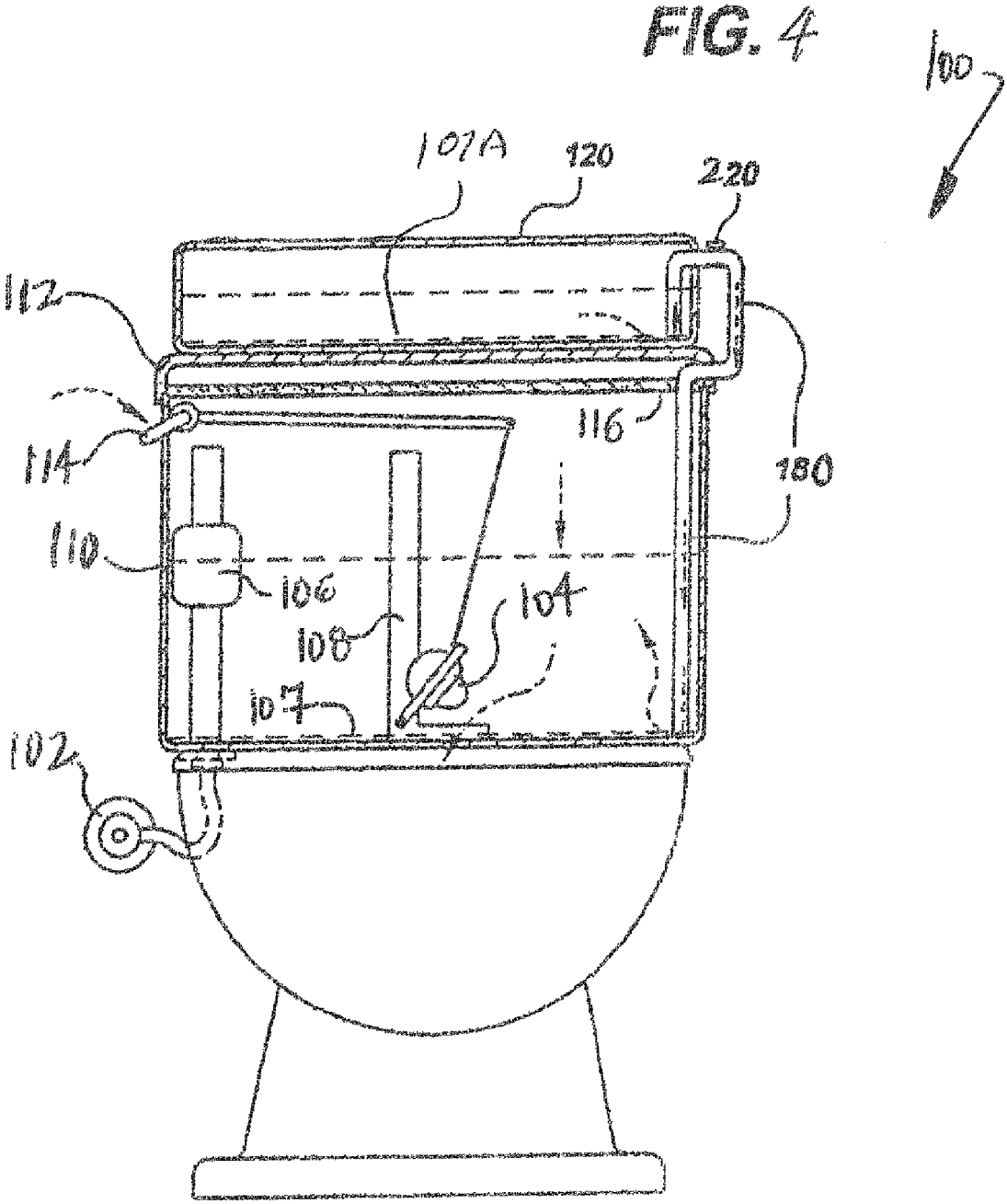
FIG. 4 is a view of the water conservation system in operation, wherein the toilet has been flushed and the siphon is initiated as the water level in the tank drops.

For example, the toilet 101 comprises a tank 110 that stores water, a tank lid 112, and a flush lever 114 for flushing the toilet 101. FIG. 2 illustrates a high water level 103 when the tank 110 is generally full. When the flush lever 114 is pushed, the flapper 104 in the tank 110 is lifted open, allowing the water stored in the tank 110 to quickly drain into the toilet bowl via an opening beneath the flapper 104 (e.g., a flush). FIG. 2 also shows a low water level 107 when the tank is generally empty (e.g., at the conclusion of a flush). Prior to the flush, the water level in the tube 180 is supported by and is equal to the high water level 103. When the water level 103 drops, the water level in the tube 180 also drops, creating a vacuum in the tube 180 and thereby inducing a siphon. By this time the flapper 104 closes. Once begun, the siphon draws water from the reservoir 120 via the first end 181 of the siphon tube 180. This continues until the water level in the reservoir 120 drops to the tube opening 181 (e.g., the reservoir is empty), at which time the siphon is broken due to air entering into the tube 180. The siphon occurs during and before completion of the normal tank refill cycle. When the float 106 drops, a relatively long refill cycle from the source 102 occurs. The overflow tube 108 prevents the tank 110 from overflowing by allowing excess water to drain into the toilet bowl.

The water conservation system 100 of the present invention comprises a reservoir 120 for storing water that is harvested from a faucet. The present invention is not limited to use of water from a faucet, for example water from anywhere may be used (e.g., shower). The reservoir 120 may be placed above, upon, or attached to the toilet 101, for example atop the lid 112 of the toilet tank 110. In some embodiments, the reservoir 120 has a first side, a second side, a top surface, a bottom surface 111, and an inner cavity.

The water conservation system 100 further comprises a tube (e.g., siphon tube 180) fluidly connecting the inner cavity of the reservoir 120 to the inner cavity of the toilet tank 110. The siphon tube 180 has a first end 181, a second end 182, and an elevated portion 183. The first end 181 is oriented near the bottom surface 111 of the reservoir 120. The second end 181 is oriented near the bottom surface of the tank 110. The elevated portion 183 has a crest that is oriented above the first end 181 of the siphon tube 180.

In some embodiments, the siphon tube 180 (e.g., the elevated portion) extends out of the reservoir 120 via a first aperture. In some embodiments, the first aperture 131 is disposed in the first side or second side of the reservoir 120. The first aperture 131 may be near the top surface of the reservoir 120 or somewhere in between the top surface and the bottom surface 111. The first aperture 131 is adapted for allowing the passage of the siphon tube 180.

In some embodiments, the siphon tube 180 extends downwardly from the first aperture 131 and in between the toilet tank 110 and the lid 112 of the toilet tank 110. In some embodiments, a gasket 116 is disposed between the lid 112 and the toilet tank 110. The gasket 116 can help accommodate entry of the siphon tube 180 into the toilet tank 110. In some embodiments, the siphon tube 180 passes through a second aperture disposed in the gasket 116. In some embodiments, the gasket 116 is semi-rigid foam. The gasket 116 may be flexible enough to bend around the corners of the tank rim (between the toilet tank 110 and the lid 112). The gasket 116 may be strong enough to support the lid 112 and the reservoir 120 without compressing. In some embodiments, the gasket 116 is an extrusion with a shape to accommodate the rim of the toilet tank 110 and the underside of the lid 112 in a generic way so as to be compatible with many different toilet tank 110 designs. In some embodiments, the design of the gasket 116 is such that it does not cave in or slide on the underside of the lid 112. The extrusion/gasket 116 should have a grip on the tank rim by virtue of the groove shape of the extrusion.

In some embodiments, the siphon tube 180 materializes in part as a water tight connector or bushing in the reservoir wall including a 90 degree el and stem to opening 181. The remaining section or sections of tube 180 being external of the reservoir.

The siphon tube 180 alternatively may go directly from the reservoir 120 to the tank 110 (see FIG. 1A).

The siphon tube 180 utilizes a siphoning mechanism to deliver water from the reservoir 120 into the toilet tank 110. Siphoning mechanisms are well known to one of ordinary skill in the art. For example, the siphoning mechanism works such that when the toilet tank 110 is emptied, water is drawn into the toilet tank 110 from the reservoir 120 via the siphon tube 180. Because water from the reservoir 120 is used to help fill the tank 110, the water supply 102 supplies less water to fill the tank 110.

In some embodiments, an air vent 220 is disposed in the siphon tube 180, for example in a portion of the tube that is outside of the inner cavity of the reservoir 120 and outside of the toilet tank 110. Another example may be inside the reservoir 120.

The air vent 220 is moveable between an open and closed position. When air in the tube 180 is in a negative pressure, vent 220 is in the closed position (e.g., no air can enter the siphon tube 180 via the air vent 220). When air in the tube 180 is in a positive pressure, vent 220 is in the open position.

In some embodiments, the air vent 220 is moved to the open position when water is added to the reservoir 120. In some embodiments, the air vent 220 is moved to the closed position to allow the siphoning mechanism to function. In some embodiments, the air vent 220 is constructed from a flexible material comprising a rubber. In some embodiments, the air vent is a wedge type 220. In some embodiments, the air vent is a membrane type 220A. The air vent is not limited to these types.

In some embodiments, a lid 140 (e.g., first lid) is disposed in the top surface 113 of the reservoir 120. The first lid 140 is moveable between an open position and a closed position respectively allowing and preventing access to the inner cavity of the reservoir 120. In some embodiments, the first lid 140 is pivotally attached in the top surface 113 of the reservoir 120 via an attachment means (e.g., a hinge). A user can harvest the water from the faucet in a pitcher 160 and dump it into the reservoir 120 via the first lid 140. In some embodiments, the reservoir is constructed so as to accommodate the delivery of water via tubing.

The pitcher 160 may be constructed from a variety of materials. For example, in some embodiments, the pitcher is constructed from a plastic. In some embodiments, the pitcher is constructed from a fracture resistant material. The pitcher 160 is shaped to fit into a sink. In some embodiments, the pitcher 160 comprises a handle for providing an easy means of griping the pitcher 160. In some embodiments, the pitcher 160 holds between about 0.25 and 0.5 gallons of water. In some embodiments, the pitcher 160 holds between about 0.5 and 1 gallon of water. In some embodiments, the pitcher 160 holds between about 1 to 2 gallons of water.

The reservoir 120 may be constructed in a variety of shapes. For example, in some embodiments, the reservoir 120 has a cross section that is shaped generally like a rectangle, a circle, an oval, a rhombus, a trapezoid, a parallelogram, or a variation or combination thereof. The reservoir 120 is not limited to the aforementioned shapes. In some embodiments, the reservoir 120 is constructed without a hinge and instead has a simple removable lid with plug openings at various locations around its perimeter lip.

The reservoir 120 may be constructed from a variety of materials and in a variety of designs. For example, in some embodiments, the reservoir 120 is constructed from a material comprising a plastic, a metal, the like, or a combination thereof. In some embodiments, the reservoir 120 is constructed from a material comprising a transparent, a semi-transparent, or an opaque material. In some embodiments, the water level in the inner cavity of the reservoir 120 may be seen. In some embodiments, the reservoir 120 also features a means of indicating the water level in the inner cavity.

The siphon tube 180 may be constructed from a variety of materials. For example, in some embodiments, the siphon tube 180 is constructed from a material comprising a plastic, a metal, the like, or a combination thereof. The siphon tube 180 should have an internal volume sufficient to consistently start the siphoning mechanism.

The siphon tube 180 may be constructed in various forms. For example, in some embodiments, the first end 181 and/or second end 182 are generally flat. In some embodiments, the first end 181 and/or second end 182 are generally beveled. In some embodiments, the first end 181 and/or second end 182 are notched 186 (see FIG. 6). In some embodiments, the first end 181 of the tube 180 reaches near the bottom of the reservoir. In some embodiments, the second end 182 of the tube 180 reaches near the bottom of the tank. In some embodiments, the tube 180 can be cut to accommodate a user's needs.

As used herein, the term "near the bottom" refers to between about 0 to 2 inches from the bottom. For example, an embodiment wherein the first end 181 of the tube 180 reaches near the bottom of the reservoir 120 includes a tube 181 is raised between 0 to 2 inches above the bottom of the reservoir 120.

In some embodiments, when the first end 181 is about 0 inches from the bottom surface there is a means for water to enter or exit the tube 180. For example, the means includes a bevel, a water aperture 185, or the like. In some embodiments, when the first end 181 is between about 0 to 0.5 inches from the bottom surface there is a means (e.g., bevel, water aperture 185) for water to enter or exit the tube 180.

In some embodiments, when the first end 181 is between about 0.05 to 1.0 inches from the bottom surface there is a means (e.g., bevel, water aperture 185) for water to enter or exit the tube 180. In some embodiments, when the first end 181 is between about 1.0 to 2.0 inches from the bottom surface there is a means (e.g., bevel, water aperture 185) for water to enter or exit the tube 180. In some embodiments, when the first end 181 is more than about 2 inches from the bottom surface there is a means (e.g., bevel, water aperture 185) for water to enter or exit the tube 180

In some embodiments, when the second end 182 is about 0 inches from the bottom surface there is a means for water to enter or exit the tube 180. For example, the means includes a bevel, a water aperture 185, or the like. In some embodiments, when the second end 182 is between about 0 to 0.05 inches from the bottom surface there is a means (e.g., bevel, water aperture 185) for water to enter or exit the tube 180.

In some embodiments, when the second end 182 is between about 0.05 to 1.0 inches from the bottom surface there is a means (e.g., bevel, water aperture 185) for water to enter or exit the tube 180. In some embodiments, when the second end 182 is between about 1.0 to 2.0 inches from the bottom surface there is a means (e.g., bevel, water aperture 185) for water to enter or exit the tube 180. In some embodiments, when the second end 182 is more than about 2 inches from the bottom surface there is a means (e.g., bevel, water aperture 185) for water to enter or exit the tube 180.

In some embodiments, the first end 181 of the tube 180 or a portion thereof is between about 0 to 0.1 inches from the bottom surface (e.g., reservoir 120). In some embodiments, the first end 181 of the tube 180 or a portion thereof is between about 0.1 to 0.25 inches from the bottom surface (e.g., reservoir 120). In some embodiments, the first end 181 of the tube 180 or a portion thereof is between about 0.25 to 0.5 inches from the bottom surface (e.g., reservoir 120). In some embodiments, the first end 181 of the tube 180 or a portion thereof is more than about 0.5 inches from the bottom surface (e.g., reservoir 120).

In some embodiments, the second end 182 of the tube 180 or a portion thereof is between about 0 to 0.1 inches from the bottom surface (e.g., tank). In some embodiments, the second end 182 of the tube 180 or a portion thereof is between about 0.1 to 0.25 inches from the bottom surface (e.g., tank). In some embodiments, the second end 182 of the tube 180 or a portion thereof is between about 0.25 to 0.5 inches from the bottom surface (e.g., tank). In some embodiments, the second end 182 of the tube 180 or a portion thereof is more than about 0.5 inches from the bottom surface (e.g., tank).

In some embodiments, a portion of the first end 181 of the tube 180 touches the bottom surface of the reservoir 120 and a portion of the first end 181 is open to the reservoir (e.g., beveled). In some embodiments, the first end 181 of the tube 180 touches the bottom surface of the reservoir 120 and a water aperture 185 is disposed in the tube 180 (e.g., at or near the first end 181) for allowing the passage of water in or out of the tube 180 (see FIG. 6).

In some embodiments, a portion of the second end 182 of the tube 180 touches the bottom surface of the reservoir 120 and a portion of the second end 182 is open to the tank (e.g., beveled). In some embodiments, the second end 182 of the tube 180 touches the bottom surface of the reservoir 120 and a water aperture 185 is disposed in the tube 180 (e.g., at or near the second end 182) for allowing the passage of water in or out of the tube 180 (see FIG. 6).

The present invention also features a kit for adapting to a toilet for water conservation. The kit may comprise a plurality of tubes and/or elbows/joints and/or gaskets. The components of the kit may be used to construct the water conservation system 100 of the present invention.

As used herein, the term "about" refers to plus or minus 10% of the referenced number. For example, an embodiment wherein the second end 182 of the tube 180 is about 0.5 inches from the bottom surface includes a tube 180 having a second end 182 that is between 0.45 and 0.55 inches from the bottom surface.

In some embodiments, a fitting or a leg is disposed on the first end 181 and/or second end 182 of the tube 180. The fitting or leg may help keep the siphon tube 180 in place, for example keep the tube 180 at the appropriate distance from the bottom surface of the reservoir 120/tank.

In some embodiments, a portion of the tube below the elevated portion and adjacent to the first end (e.g., across from) forms a downward flow tube section. The downward flow tube section curves towards the second end of the tube (see FIG. 2).

Figure 5:
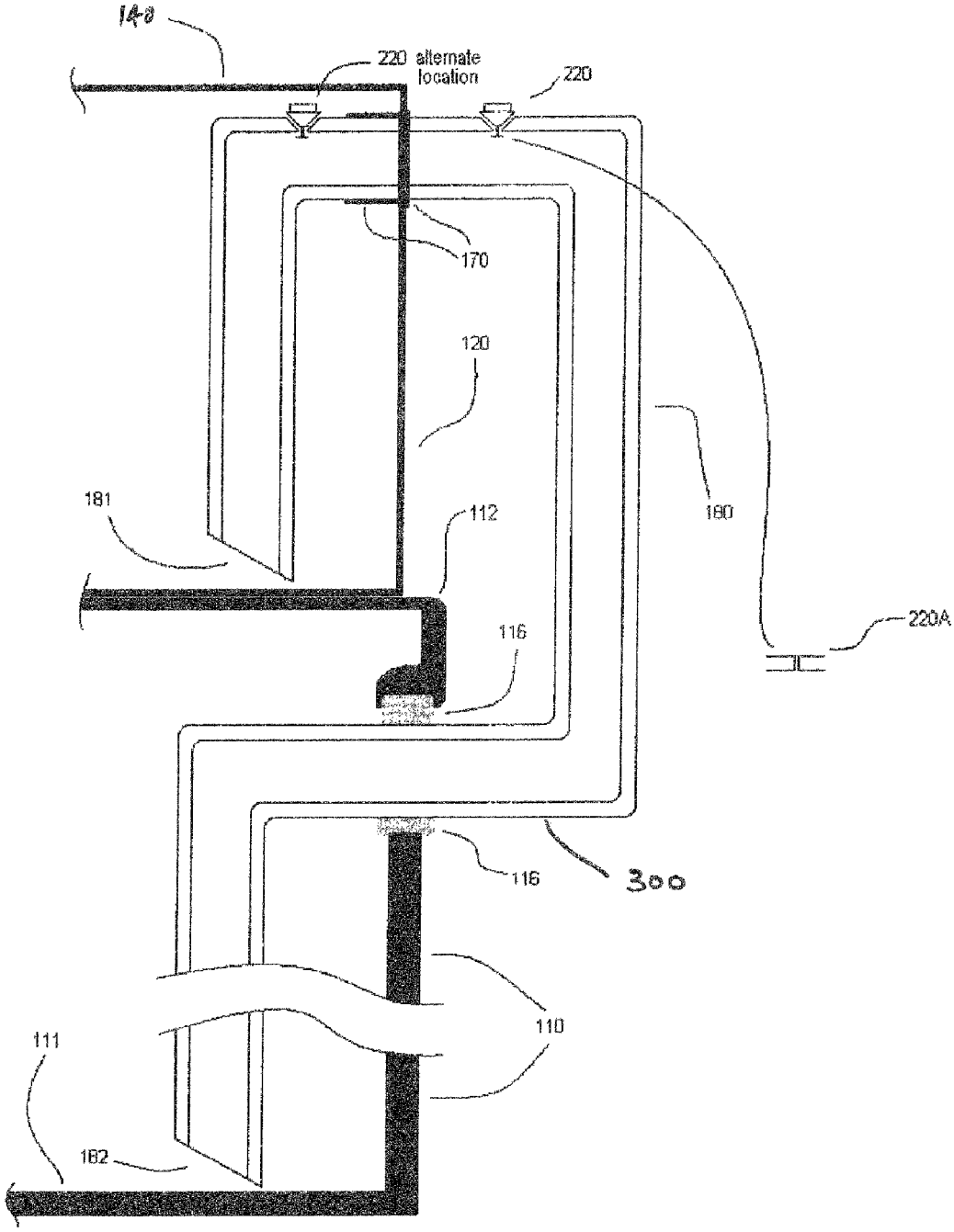
FIG. 5 is a cross sectional view of the water conservation system, wherein the ends of the siphon tube are beveled.
Figure 6:
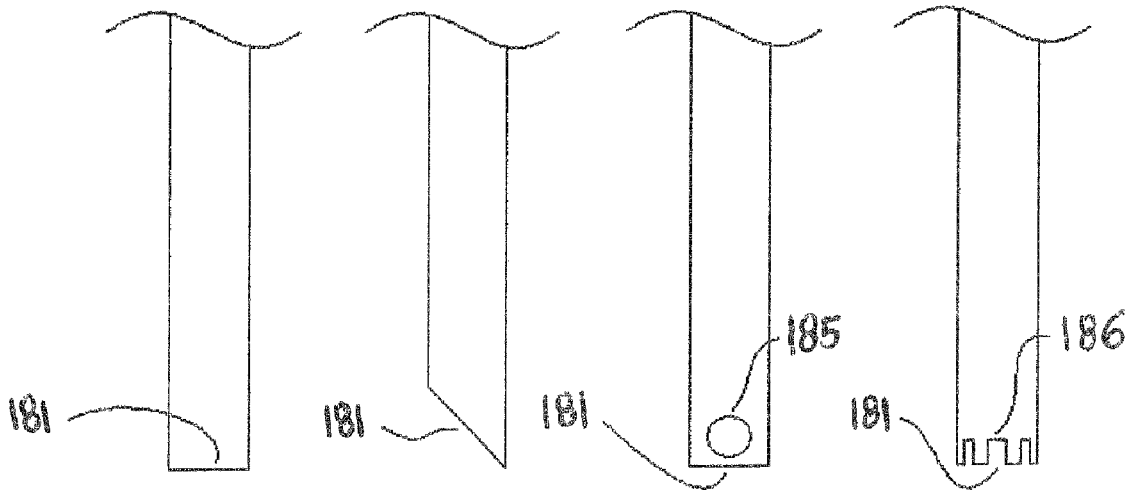
FIG. 6 is a side view of various first ends of the tube of the water conservation system of the present invention.

As shown in FIG. 5, in some embodiments, the siphon tube 180 comprises a section of horizontal tubing 300. In some embodiments, the horizontal tubing is disposed on the siphon tube 180 at below the elevated portion 183 towards the second end of the siphon tube 182. The horizontal tubing may allow water to remain therein once the siphoning has finished. The horizontal tubing may eliminate the need to prime the siphon tube 180. In some embodiments, the downwardly flow tube section allows for the section of horizontal tubing to be present.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A water conservation system comprising:

(a) a reservoir for storing water;

(b) a toilet water tank for storing water, the toilet water tank is disposed below the reservoir, the volume of the reservoir is smaller than the volume of the storage tank; and (c) a tube fluidly connecting the reservoir and the tank, wherein the tube is configured such that a first end of the tube reaches near a bottom surface of the reservoir, a second end of the tube reaches near a bottom surface of the tank, and an elevated portion of the tube with a crest that is oriented above the first end, the toilet water tank is connected to the reservoir via the tube and is also connected to a water supply, whereby, with the reservoir full of storage water, a siphon is created in the tube when the water level in the toilet tank begins to drop, the storage water is siphoned from the reservoir through the tube and into the toilet water tank, the siphon is broken when the water level in the reservoir is below the first end of the tube.

2. The water conservation system of claim 1 further comprising a first lid disposed in the reservoir moveable between an open position and a close position respectively allowing and preventing access to the reservoir.

3. The water conservation system of claim 1 further comprising an air vent disposed in the tube moveable between an open position and a closed position, wherein in the open position the air vent allows air to escape and the closed position allows a vacuum to be maintained.

4. The water conservation system of claim 1, wherein the crest of the elevated portion is near a top surface of the reservoir.

5. The water conservation system of claim 1, wherein a portion of the tube below the elevated portion and adjacent to the first end forms a downward flow tube section, the downward flow tube section curves towards the second end of the tube.

6. The water conservation system of claim 1, wherein the first end of the tube is between 0 to 2 inches from the bottom surface of the reservoir a means for water to enter and exit the tube.

7. The water conservation system of claim 6, wherein the means for water to enter and exit the tube includes a bevel and a water aperture.

8. The water conservation system of claim 1, wherein the second end of the tube is between 0 to 2 inches from the bottom surface of the tank a means for water to enter and exit the tube.

9. The water conservation system of claim 8, wherein the means for water to enter and exit the tube includes a bevel and a water aperture.

10. A water conservation system kit for adapting to a toilet having a toilet tank, said kit comprising:

(a) a reservoir for storing water for placing above the toilet tank, the volume of the reservoir is smaller than the volume of the storage tank; and (b) a tube for fluidly connecting the reservoir and the toilet tank, wherein the tube is configured such that a first end reaches near a bottom surface of the reservoir, a second end of the tube is adapted to reach near a bottom surface of the tank, and an elevated portion of the tube with a crest is oriented above the first end, the toilet water tank is adapted to connect to the reservoir via the tube and is also connected to a water supply, whereby, with the reservoir full of storage water, a siphon is created in the tube when the water level in the toilet tank begins to drop, the storage water is siphoned from the reservoir through the tube and into the toilet water tank, the siphon is broken when the water level in the reservoir is below the first end of the tube.

11. The water conservation system of claim 10 further comprising a first lid disposed in the reservoir moveable between an open position and a close position respectively allowing and preventing access to the reservoir.

12. The water conservation system of claim 10 further comprising an air vent disposed in the tube moveable between an open position and a closed position, wherein in the open position the air vent allows air to escape and the closed position allows a vacuum to be maintained.

13. The water conservation system of claim 10, wherein the crest of the elevated portion is near a top surface of the reservoir.

14. The water conservation system of claim 10, wherein a portion of the tube below the elevated portion and adjacent to the first end forms a downward flow tube section, the downward flow tube section curves towards the second end of the tube.

15. The water conservation system of claim 10, wherein the first end of the tube is between 0 to 2 inches from the bottom surface of the reservoir a means for water to enter and exit the tube.

16. The water conservation system of claim 15, wherein the means for water to enter and exit the tube includes a bevel and a water aperture.

17. The water conservation system of claim 10, wherein the second end of the tube is between 0 to 2 inches from the bottom surface of the tank a means for water to enter and exit the tube.

18. The water conservation system of claim 17, wherein the means for water to enter and exit the tube includes a bevel and a water aperture.

* * * * *